US011324301B2

(12) United States Patent
Korba

(10) Patent No.: US 11,324,301 B2
(45) Date of Patent: May 10, 2022

(54) COSMETIC COMPACT WITH PAPER LABELING

(71) Applicant: Gary Korba, New York, NY (US)

(72) Inventor: Gary Korba, New York, NY (US)

( * ) Notice: Subject to any disclaimer, the term of this patent is extended or adjusted under 35 U.S.C. 154(b) by 670 days.

(21) Appl. No.: 16/146,103

(22) Filed: Sep. 28, 2018

(65) Prior Publication Data

US 2019/0133293 A1 May 9, 2019

Related U.S. Application Data

(60) Provisional application No. 62/581,993, filed on Nov. 6, 2017.

(51) Int. Cl.

| | |
|---|---|
| ***A45D 27/22*** | (2006.01) |
| ***A45D 33/00*** | (2006.01) |
| ***A45D 42/04*** | (2006.01) |
| ***A45D 40/24*** | (2006.01) |
| ***A45D 40/18*** | (2006.01) |
| ***A45C 11/00*** | (2006.01) |

(52) U.S. Cl.

CPC ..... *A45D 33/008* (2013.01); *A45C 11/00* (2013.01); *A45D 40/18* (2013.01); *A45D 40/24* (2013.01); *A45D 42/04* (2013.01); *A45D 2200/25* (2013.01)

(58) Field of Classification Search

CPC .... A45D 33/00; A45D 33/003; A45D 33/005; A45D 33/008; A45D 40/18; A45D 40/22; A45D 40/24; A45D 2040/224; A45D 2040/225; A45C 11/008; A45C 13/002; A45C 5/005

See application file for complete search history.

(56) References Cited

U.S. PATENT DOCUMENTS 3,222,085 A * 12/1965 Young ..... B42D 3/04 281/34
6,901,937 B2 * 6/2005 Sebban ..... A45D 40/221 132/293
2014/0034080 A1 * 2/2014 Paquet ..... B65D 43/26 132/286

FOREIGN PATENT DOCUMENTS

CA 2481897 * 4/2003

* cited by examiner

*Primary Examiner* — Rachel R Steitz

(74) *Attorney, Agent, or Firm* — Tarter Krinsky & Drogin LLP

(57) ABSTRACT

A cosmetic compact being incorporated with outer wrap material. The cosmetic compact including a cover, the cover including a frame and a top panel, the frame including four sidewalls; a cosmetic holder, the cosmetic holder including a platform and a bottom panel, the platform including four sidewalls, a hinge; and an outer wrap material, wherein the top panel, the bottom panel and the hinge are affixed to the outer wrap material in a first step and (1) the frame is fixedly secured the top panel and (2) the platform to be fixedly secured to the bottom panel in a second step thereby allowing the outer wrap material to be incorporated into the cosmetic compact.

19 Claims, 14 Drawing Sheets

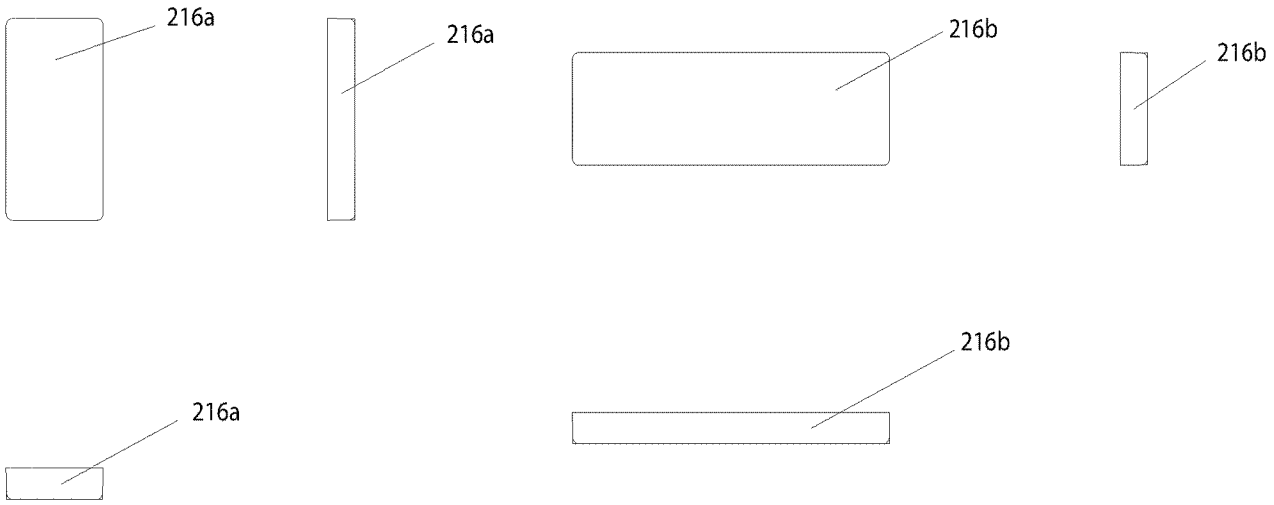
Figure 37b
Figure 37a
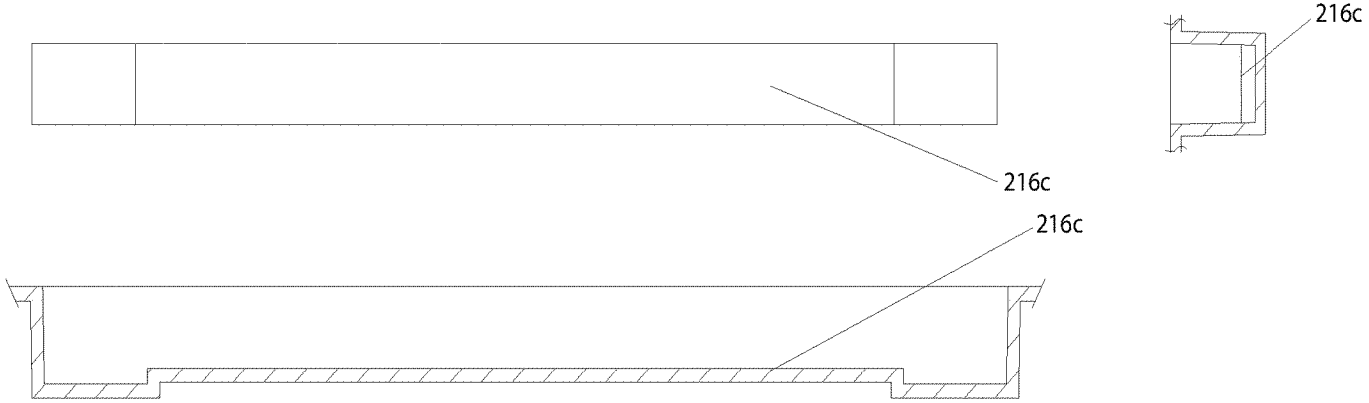
Figure 38

COSMETIC COMPACT WITH PAPER LABELING

CROSS REFERENCE TO RELATED APPLICATION

This application claims priority to U.S. Provisional Application Ser. No. 62/581,993 filed Nov. 6, 2017, hereby incorporated by reference in its entirety.

BACKGROUND

The disclosed technology is directed towards a cosmetic compact with paper labeling.

Cosmetic compacts are used to store cosmetic materials such as eyeshadow, blush, concealer, etc. These compacts can have two parts: a body and a cover affixed to the body via a plastic hinge. In many cases, the body and the cover are formed from plastics using conventional injection molding techniques. During this process, the body and cover are molded to include protrusions for forming a first hinge portion and a second hinge portion, respectively. These hinge portions are married to one another to form a final compact product. These hinges, however, are prone to breaking as these plastic hinges break when under relatively little stress. When stored in a women's purse, the damage to the items inside the purse when the hinge breaks is often disastrous.

Also, during conventional manufacturing processes, the pieces of the compact are molded and then assembled. If a customer wants to add labeling to the compact, the labeling is performed as an additional step, after assembly, which increases the cost of the final compact product considerably.

SUMMARY

The disclosed technology is directed towards a cosmetic compact with labeling incorporated into the cosmetic compact during assembly.

In some implementations, a cosmetic compact can comprise: a cover, the cover including a frame and a top panel, the frame including four sidewalls; a cosmetic holder, the cosmetic holder including a platform and a bottom panel, the platform including four sidewalls, a hinge; and an outer wrap material, wherein the top panel, the bottom panel and the hinge are affixed to the outer wrap material in a first step and (1) the frame is fixedly secured the top panel and (2) the platform to be fixedly secured to the bottom panel in a second step thereby allowing the outer wrap material to be incorporated into the cosmetic compact.

In some implementations, the top panel can be affixed within the boundaries created by the four sidewalls of the frame. In some implementations, the bottom panel can be affixed within the boundaries created by the four sidewalls of the platform.

In some implementations, the hinge can include a spine and spine wrap, wherein the spine wrap is adhered to a spine.

In some implementations, the outer wrap material can have a width equal to a width of the top panel, the bottom panel and the spine so that the outer wrap material is within the boundaries created by three of the four sidewalls of the frame and the boundaries created by three of the four sidewalls of the platform when assembled. In some implementations, the outer wrap material can have a length greater than a length of the top panel, the bottom panel, the spine. In some implementations, spacing can be created between (1) the top panel and the spine and (2) the bottom panel and the spine. In some implementations, the spacing can allow the hinge to movably connect the cosmetic holder to the cover.

In some implementations, the frame can include an opening for a mirror. In some implementations, the frame and platform can include magnets. In some implementations, the platform can include one or more wells for retaining cosmetic materials.

In some implementations, the spine can include posts and the platform can include recesses for receiving the posts, the spine being fixedly secured to the platform. In some implementations, the cosmetic compact can further comprise: angle control tabs, the angle control tabs being secured to and between the spine and frame.

In some implementations, the frame can include tabs for friction fitting with recesses of the platform. In some implementations, the outer wrap material can include wings. In some implementations, the spine can include raised edges for receiving the wings of the outer wrap material.

An advantage of the disclosed cosmetic compact is that the cosmetic compact can be assembled with outer wrap material being incorporated into the assembly process. The cosmetic compact also allows the outer wrap material to have edges that are hidden from a side view of the cosmetic compact thereby providing a sleek look and design. Another advantage is a hinge that is more durable and can be designed to control an opening angle of an open compact.

BRIEF DESCRIPTION OF THE DRAWINGS

FIG. 37*a* are views of a well of the cosmetic compact as shown in FIG. 22;

FIG. 37*b* are views of a well of the cosmetic compact as shown in FIG. 22;

FIG. 38 are views of a well of the cosmetic compact as shown in FIG. 22;

DETAILED DESCRIPTION OF THE INVENTION

Figure 1:
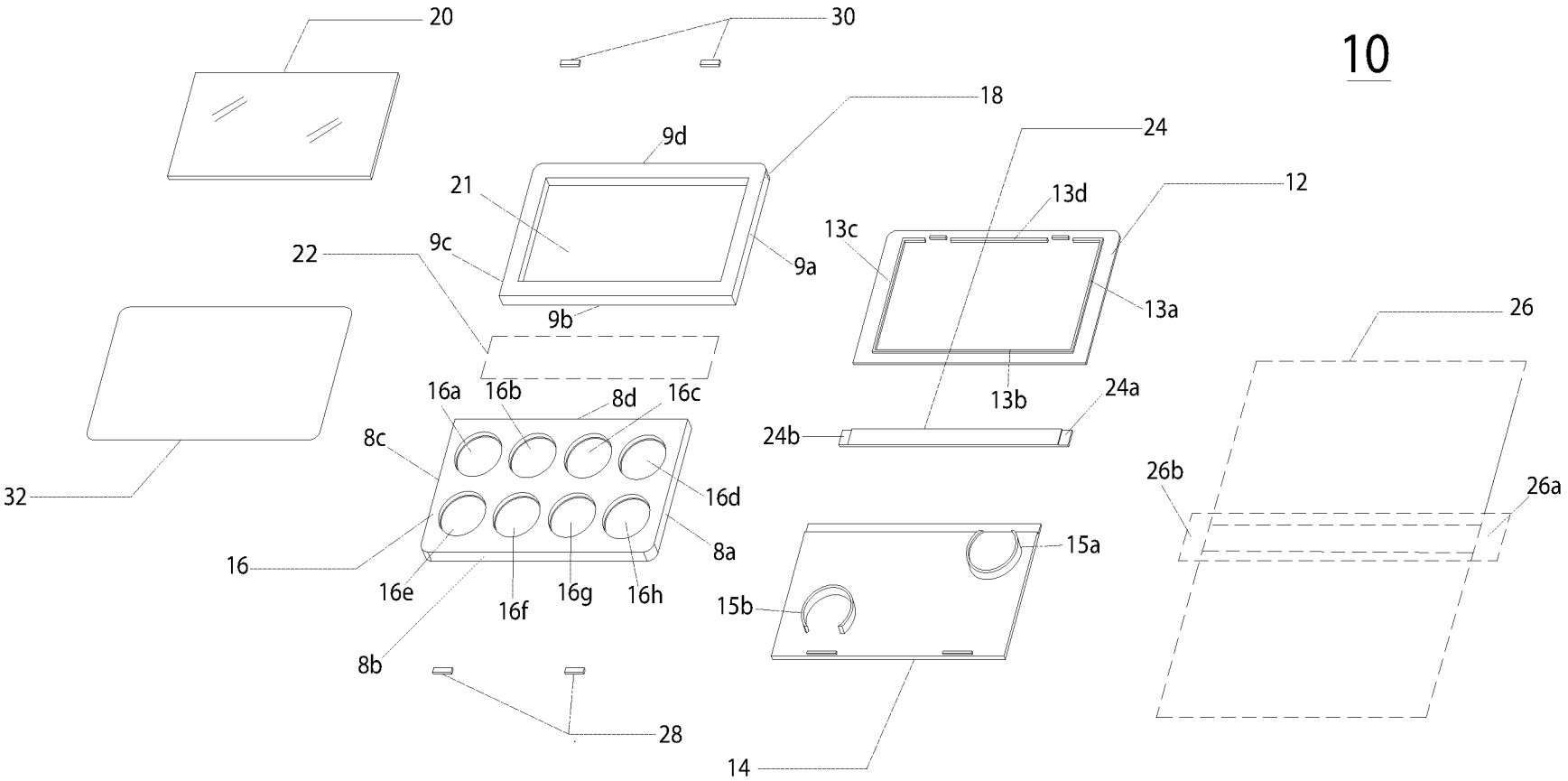
FIG. 1 is an exploded view of a cosmetic compact of the disclosed technology.

The disclosed technology relates to a cosmetic compact with labeling incorporated into the cosmetic compact during assembly. This can be achieved by having a cosmetic compact 10 that includes a top panel 12, a bottom panel 14, a platform 16, a mirror frame 18, mirror 20, spine wrap 22, a spine 24, outer wrap material 26 and magnets 28, 30, as shown in FIG. 1.

In some implementations, the top panel 12, the bottom panel 14, the platform 16, the mirror frame 18 and the spine 24 can be manufactured using injection molding. Injection molding is a manufacturing process for producing parts by injecting material into a mold. Injection molding can be performed with a host of materials, including metals, (for which the process is called die-casting), glasses, elastomers, confections, and most commonly thermoplastic and thermosetting polymers. After a product is designed, molds are made from metal, usually either steel or aluminum, and precision-machined to form the features of the desired part. Material for the part is (mixed then) fed into a heated barrel (hopper) and forced into a mold cavity through an injection gate 16*i*, where it cools and hardens to the configuration of the cavity. Injection molding is widely used for manufacturing a variety of parts. Advances in 3D printing technology, using photopolymers which do not melt during the injection molding of some lower temperature thermoplastics, can be used for some simple injection molds. Parts to be injection molded must be very carefully designed to facilitate the molding process; the material used for the part, the desired shape and features of the part, the material of the mold, and the properties of the molding machine must all be considered. The versatility of injection molding is facilitated by this breadth of design considerations and possibilities.

Figure 10:
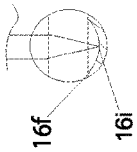
FIG. 10 is a zoomed-in view of an injection gate as shown in FIG. 6.
Figure 11:
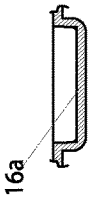
FIG. 11 is a cross-sectional side view of a well of the cosmetic compact as shown in FIG. 6.

As described above and shown in FIGS. 1 and 6-11, the platform 16 can be manufactured using molding methods known in the art using an injection material, e.g., plastic. The platform 16 can be molded to include one or more wells 16*a-h* for retaining cosmetic materials. The wells 16*a-h* can be circular but other shapes are contemplated. In some implementations, as shown in FIGS. 7 and 11, the wells 16*a-h* can have a calculated depth of any range, e.g. 0.05 mm-3 mm.

Figure 7:
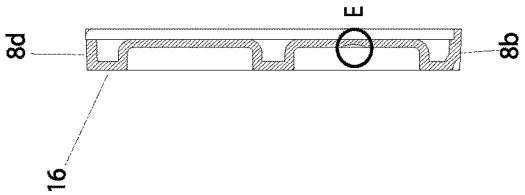
FIG. 7 is a cross-sectional side view of the platform of the cosmetic compact as shown in FIG. 1.
Figure 9:
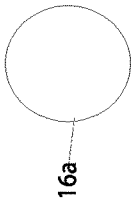
FIG. 9 is a top view of a well of the cosmetic compact as shown in FIG. 1.
Figure 6:
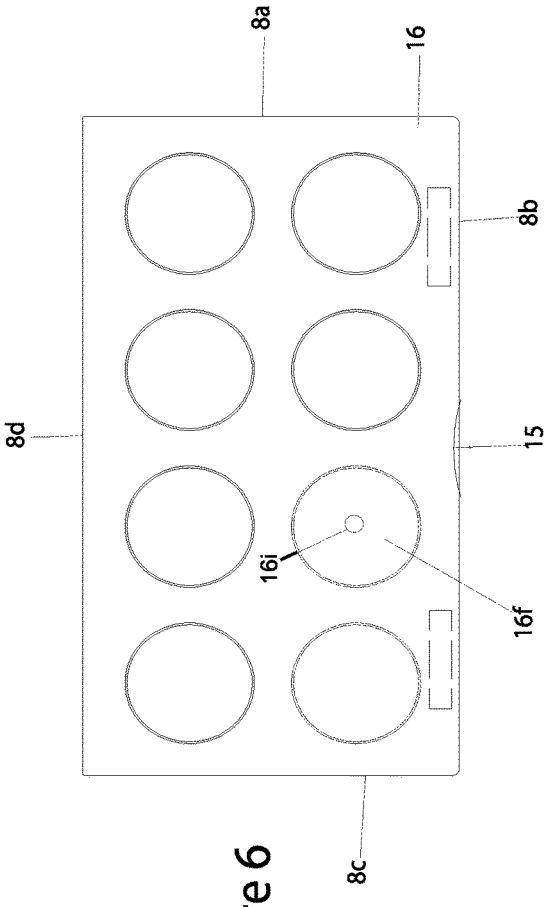
FIG. 6 is a top view of a platform of the cosmetic compact as shown in FIG. 1.
Figure 8:
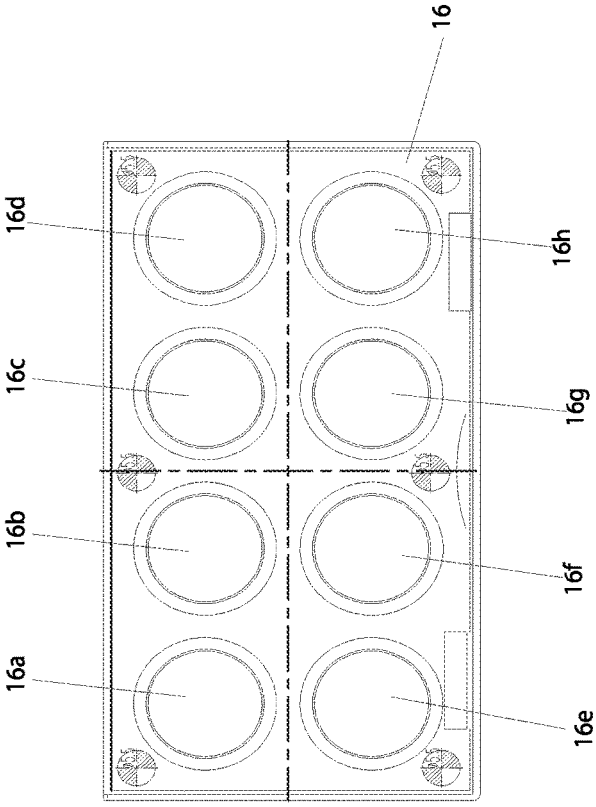
FIG. 8 is a bottom view of a platform of the cosmetic compact as shown in FIG. 1.

The sidewalls 8*a-c* of the platform 16 can be slightly longer than the depth of the wells 16*a-h*, as shown in FIGS. 1, 6 and 7 to accommodate the bottom panel 14 as will be described more fully below. In some implementations, sidewall 8*d* can be slightly shorter than sidewalls 8*a-c* to allow the bottom panel 14, spine wrap 22, spine 24 and outer wrap material 26 to be wrapped around and create a hinge 25 (FIGS. 2 and 3) of the cosmetic compact 10, as will be described more fully below.

Figure 5:
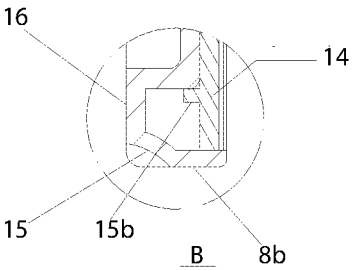
FIG. 5 is a close-up, cross-sectional view of the cosmetic compact as shown in Section B, FIG. 3.
Figure 13:
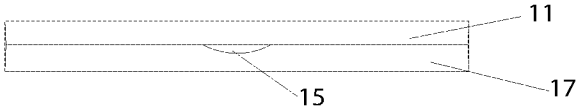
FIG. 13 is a front view of the cosmetic compact as shown in FIG. 2 in a closed position.

In some implementations, sidewall 8*b* of the platform 16 can include an indent 15 as shown in FIGS. 5 and 6. This indent 15 can be used for opening the cosmetic compact 10 when in a closed position (e.g., see FIGS. 13 and 15*b*). During the molding process, an injection gate 16*i* can be located on a part to be molded, e.g., the platform 16 has an injection gate 16*i* within well 16*f*, as shown in FIGS. 6 and 10. Gate locations, however, can vary depending on shape and size of the part to be molded.

The bottom panel 14 can be flat and have a rectangular shape but other shapes and sizes are contemplated. The bottom panel 14 can also include sealing seams 15*a-b*. The bottom panel 14 can be sized so that it fits within the sidewalls 8*a-c* of platform 16.

As shown in FIG. 1, the mirror frame 18 can include sidewalls 9*a-d*. The top panel 12 can be flat and have a rectangular shape but other shapes and sizes are contemplated. The top panel 12 can also include sealing seams 13*a-d*. The top panel 12 can be sized so that it fits within the sidewalls 9*a, c-d* of mirror frame 18. In some implementations, sidewall 9*b* can be slightly shorter than sidewalls 9*a, c-d* to allow the top panel 12, spine wrap 22, spine 24 and outer wrap material 26 to be wrapped around and create a hinge 25 of the cosmetic compact 10, as will be described more fully below.

The mirror frame 18 can be formed with an opening 21 for receiving a mirror 20. The mirror 20 can be placed within the opening 21 and in some cases adhered to the top panel 12 through the use of an adhesive; however, other adhesive methods are contemplated. The mirror frame 18 can also have a well instead of an opening, and the mirror 20 can be adhered to the bottom of the well of the mirror frame 18.

Figure 3:
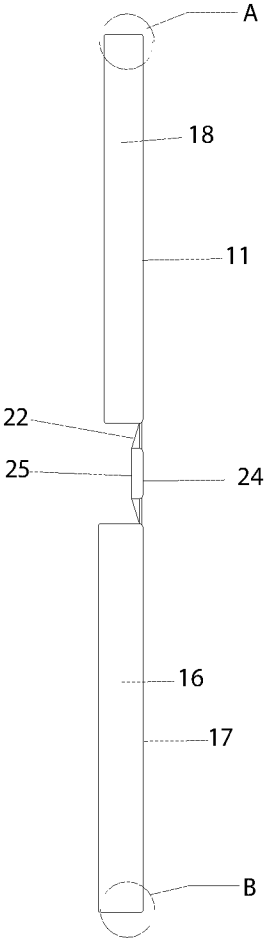
FIG. 3 is a side view of the cosmetic compact as shown in FIG. 1 in an opened position.
Figure 2:
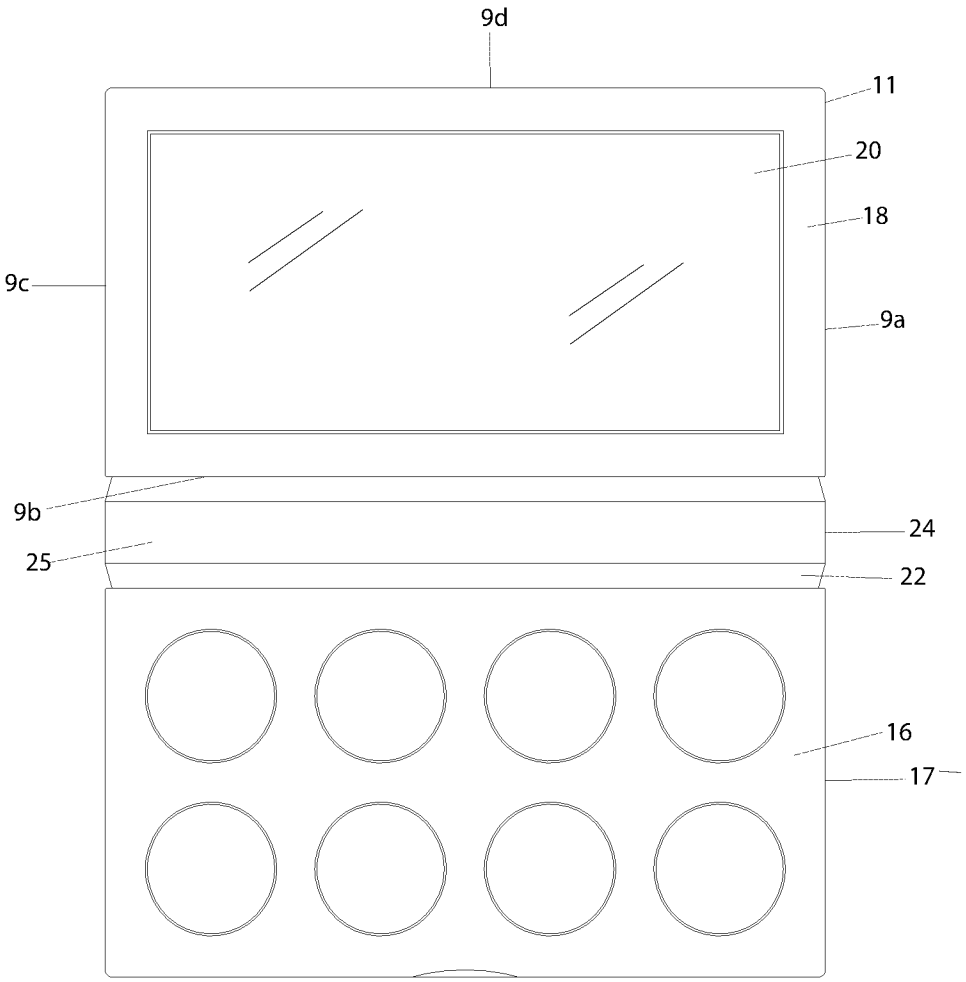
FIG. 2 is a top view of the cosmetic compact as shown in FIG. 1 in an opened position.
Figure 15A:
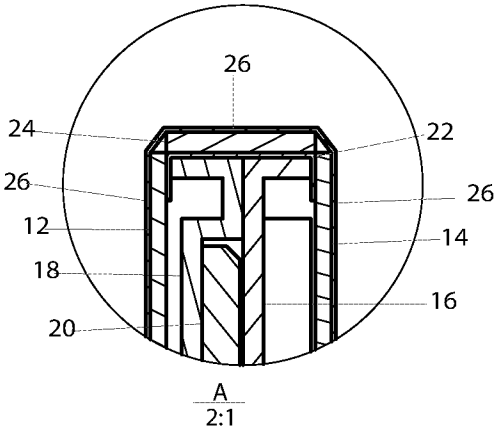
FIG. 15*a* is a close-up, cross-sectional side view of the cosmetic compact as shown in Section A, FIG. 14.
Figure 15B:
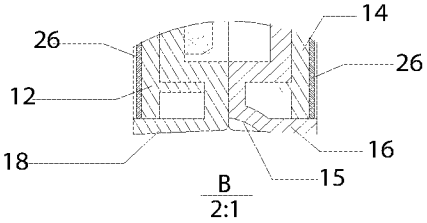
FIG. 15*b* is a close-up, cross-sectional side view of the cosmetic compact as shown in Section B, FIG. 14.
Figure 14:
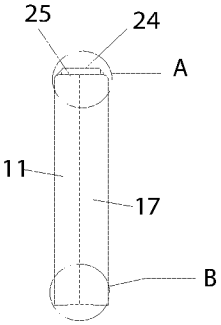
FIG. 14 is a side view of the cosmetic compact as shown in FIG. 2 in a closed position.
Figure 12:
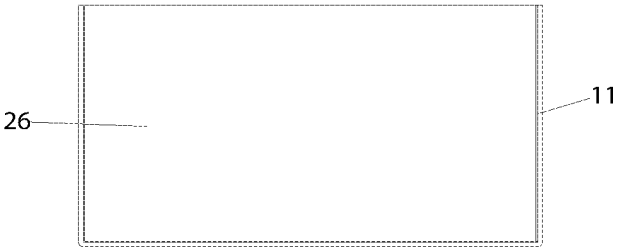
FIG. 12 a top view of the cosmetic compact as shown in FIG. 2 in a closed position.

The spine 24 can be adhered to a spine wrap 22 with an adhesive. In some implementations, the spine 24 and the spine wrap 22 can be laminated together, and then adhered to the outer wrap material 26 thereby forming a hinge 25, as shown in FIGS. 2, 3, and 15*a*. That is, the hinge 25 can be connected between the top panel 12 and bottom panel 14 with an adhesive so that the top panel 12 and the bottom panel 14 are bridged together by the hinge 25. This innovation allows the combination of injection parts with a spine wrap 22 to create the hinge 25 (FIGS. 2, 3, and 15*a*). The hinge 25 allows the cosmetic compact 10 to open to, e.g., 180 degrees (FIG. 3). The spine wrap 22 can be a paper material but other materials, e.g., plastics, polyurethane (PU), fabrics, metals, foils are contemplated.

Figure 16:
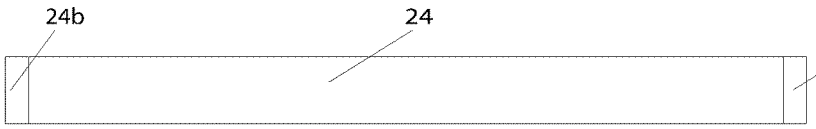
FIG. 16 is a top view of the spine as shown in FIG. 1.
Figure 17:
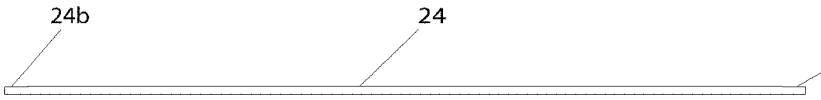
FIG. 17 is a side view of the spine as shown in FIG. 16.
Figure 18:
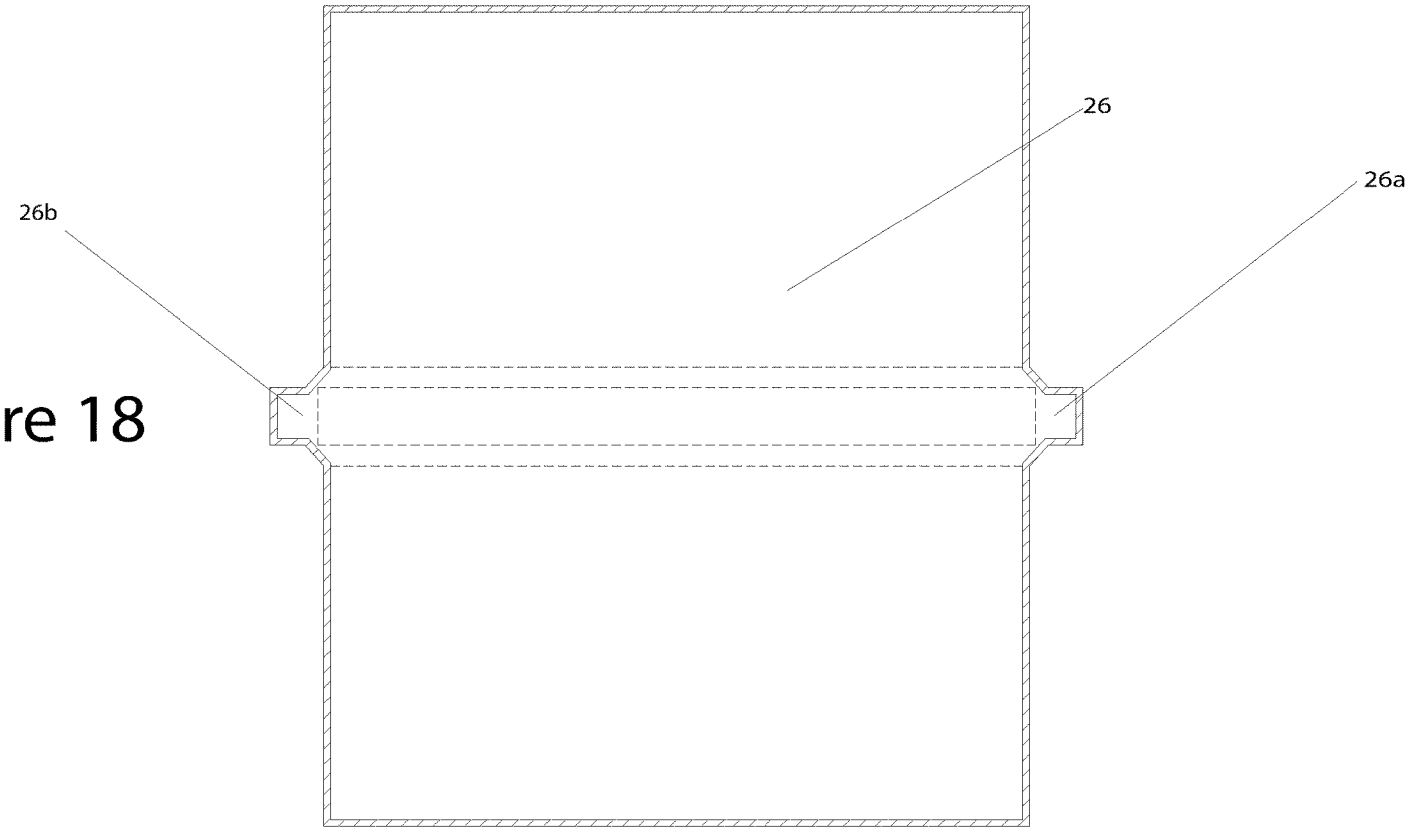
FIG. 18 is a top view of an outer wrap material used in conjunction with the spine shown in FIG. 16.

In some implementations, as shown in FIGS. 1, 16 and 17, the spine 24 can include indentations 24*a*, 24*b* near the sidewall. These indentations 24*a*, 24*b* allow the edges 26*a*, 26*b* (FIGS. 1, and 18) of the outer wrap material 26 to be folded inward and glued to the indentations so that the edges of the outer-wrap material can be hidden from view.

Figure 19:
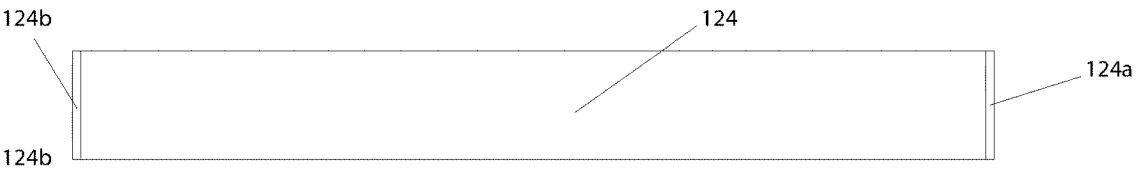
FIG. 19 is a top view of another version of a spine.
Figure 20:
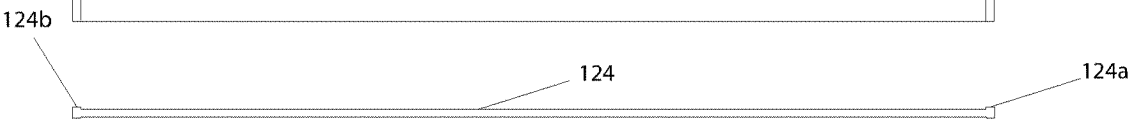
FIG. 20 is a side view of the spine as shown in FIG. 19.
Figure 21:
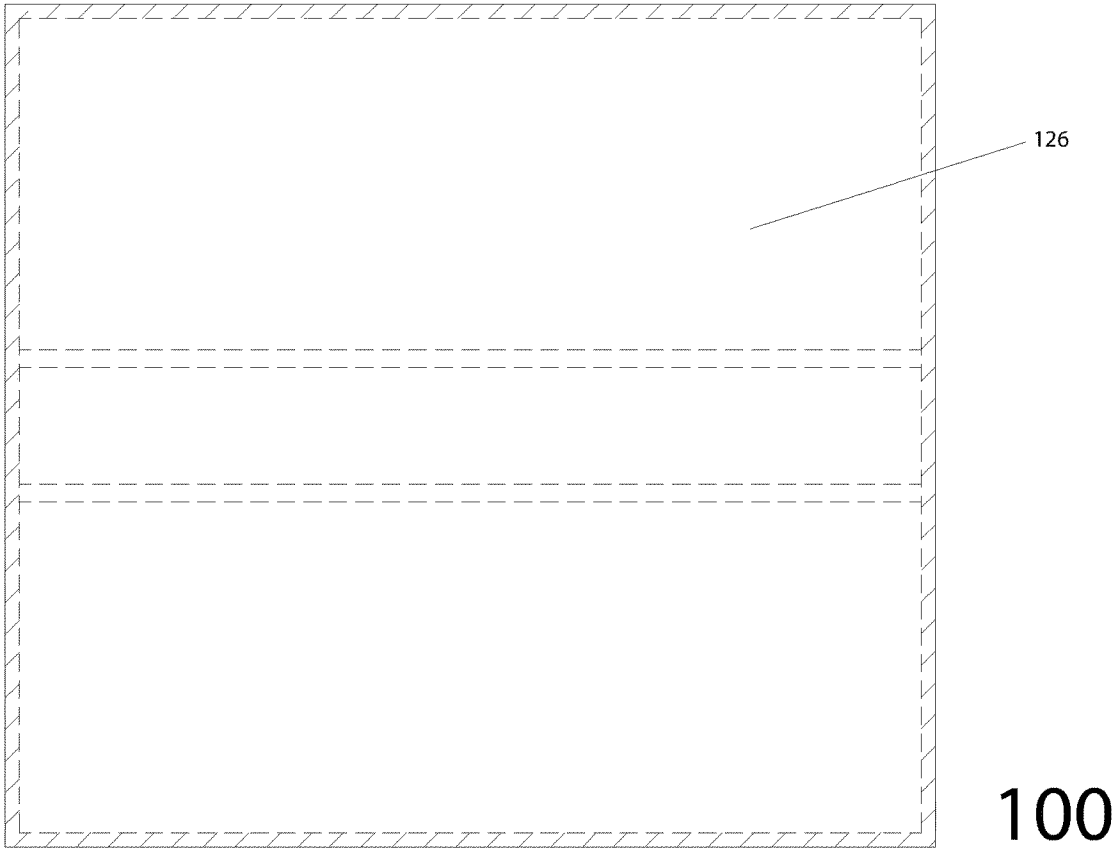
FIG. 21 is a top view of an outer wrap material used in conjunction with the spine shown in FIG. 19.

In other implementations, as shown in FIGS. 19-21, the spine 124 can include raised side walls 124*a-b*. In this implementation, the raised side walls 124*a-b* hide the edges of the outer wrap 126 (FIG. 21).

The mirror frame 18 and the platform 16 can be fitted with magnets 28, 30. Magnets 30 can be secured to the mirror frame 18 within recesses located on the mirror frame 18 and magnets 28 can be secured to the platform 16 within recesses on a ledge of the platform 16. The magnets can be adhered with heat melt glue but other securement methods are contemplated. These magnets 28, 30 are capable of magnetically securing the compact 10 in a closed position when not in use. It also allows the top cover 11 (FIGS. 2 and 3) and the cosmetic holder 17 (FIGS. 2 and 3) to provide a tight fit of contact for the cosmetic compact 10 when in a closed position so that cosmetic material does not escape the cosmetic compact 10 when not in use. In some implementations, a disc 32 (FIG. 1), e.g., a polyethylene terephthalate (PETG) disc, low density polyethylene (LDPE) disc, wax paper or other materials can be applied over the platform 16 to seal or protect cosmetic material stored within the platform 16. In some implementations, individual cosmetic trays (not shown) can be placed in openings of the wells 16*a-h*. The trays can be either removably secured or permanently secured within the wells 16*a-h* depending on application requirements.

Outer wrap material 26, e.g., paper, plastics, polyurethane (PU), fabrics, metals, or foils can be adhered to an outer surface of the top cover 11 (FIGS. 2 and 3), the cosmetic holder 17 (FIGS. 2 and 3) and the hinge 25 (FIGS. 2 and 3), as a single piece. In other implementations, the outer wrap material 26 can be adhered in one or more pieces. The outer wrap material 26 can be decorated for marketing and advertising purposes.

In some implementations, the outer wrap material 26 can be pre-cut to size so that it has the same width as the top panel 12, bottom panel 14 and spine 24. The outer wrap can have a length to accommodate a combined length of the top panel 12, bottom panel 14 and spine 24. The outer wrap can also have a space between the spine and top panel and a space between the spine and bottom panel wherein the spaces allows room for the cosmetic compact 10 to open and close.

During assembly, the top panel 12, the spine 24 and the bottom panel 14 can be glued to the outer wrap material 26 with an adhesive and the edges of the outer wrap 26*a* and 26*b* can be folded over to the indentations of the Spine 24*a* and 24*b* and glued with an adhesive. Step 1. Magnets 28 and magnets 30 can be glued to the platform 16 and mirror frame 18, respectively. Step 2.

The spine wrap 22 can be glued over the spine 24. Step 3. (In some implementations, the spine wrap 22 and spine 24 can be adhered to each other in a separate step and the combination can be glued to the outer wrap material 26 as a single piece.)

The platform 16 can be adhered to the bottom panel 14. Step 4. More specifically, as show in FIG. 5, the bottom panel 14 can be placed within the sidewalls a-c of the platform 16 so that the sidewalls 8*a-c* hide the edges of the bottom panel 14 and the edges of the outer wrap material 26. This placement allows the sealing seams 15*a-b* to be adjacent and touching the walls of well 16*d*, 16*e* (FIG. 1). A sonic weld can then be performed to weld sealing seam 15*a* to well 16*e* and sealing seam 15*b* to wells 16*d*. Other adhesive mechanisms are contemplated, e.g., adhesives. This step (Step 4) forms the cosmetic holder 17 (FIGS. 2 and 3).

Figure 4:
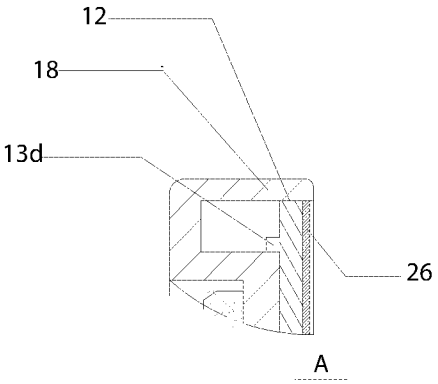
FIG. 4 is a close-up, cross-sectional view of the cosmetic compact as shown in Section A, FIG. 3.

The mirror frame 18 can be adhered to the top panel 12. Step 5. More specifically, as show in FIG. 4, the top panel 12 can be placed within the sidewalls 9*a, c-d* of mirror frame 18 so that the sidewalls 9*a, c-d*, hide the edges of the top panel 12 and the edges of the outer wrap material 26. This placement allows sealing seams 13*a-d* to be adjacent and touching the sidewalls 9*a-d* of mirror frame 18 so that a sonic weld can be performed to weld sealing seams 13-*d* to the sidewalls 9*a-d* of mirror frame 18. This step (Step 5) forms a top cover 11 (FIGS. 2 and 3). Please note, steps 3-5 can be done one at time or simultaneously.

The mirror 20 can be glued within the mirror frame (Step 6) and a dust cover 32 can be placed over the platform 16 (Step 7). Once these steps (Steps 1-7) are completed, the cosmetic compact can be folded closed and packaged for shipping. Please note, that the order of these steps are for illustrative purposes as these steps can be performed in several different orders and combinations.

As shown in FIG. 22-27, the cosmetic compact 200 can include a top panel 212, a bottom panel 214, a platform 216, a mirror frame 218, mirror 220, spine wrap 222, a spine 224, outer wrap material 226 and magnets 228, 230.

In some implementations, the top panel 212, the bottom panel 214, the platform 216, the mirror frame 218 and the spine 224 can be manufactured using injection molding, as described above.

As shown in FIGS. 22 and 34-36, the platform 216 can be manufactured using molding methods known in in the art using an injection material, e.g., plastic. The platform 216 can be molded to include one or more wells 216*a-c* for retaining cosmetic materials and cosmetic tools, e.g., cosmetic trays and applicators. The wells 216*a-c* can be rectangular but other shapes are contemplated. In some implementations, as shown in FIGS. 37*a*, 37*b* and 38, the wells 216*a-b* and *c* can have a calculated depth of any range, e.g., 0.05-3 mm.

The sidewalls 208*a-d* of the platform 216 can be slightly longer than the depth of the wells 216*a-c* so as to accommodate the bottom panel 214 as will be described more fully below. In some implementations, sidewall 208*d* (FIG. 22) can be slightly shorter than sidewalls 208*a, b* and *c* so as to allow the outer wrap material 226 to be wrapped around a hinge 225 (FIG. 25) of the cosmetic compact 200.

Figure 22:
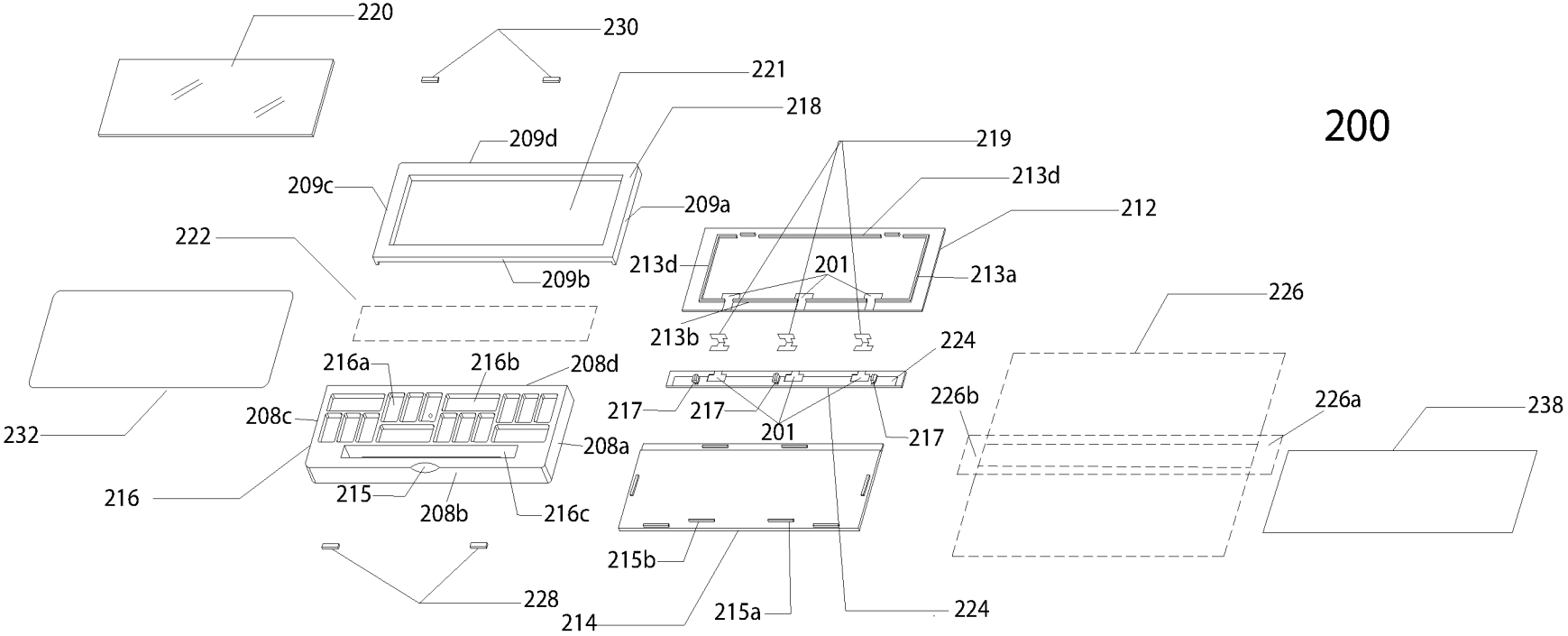
FIG. 22 is an exploded view of a cosmetic compact of the disclosed technology.
Figure 28:
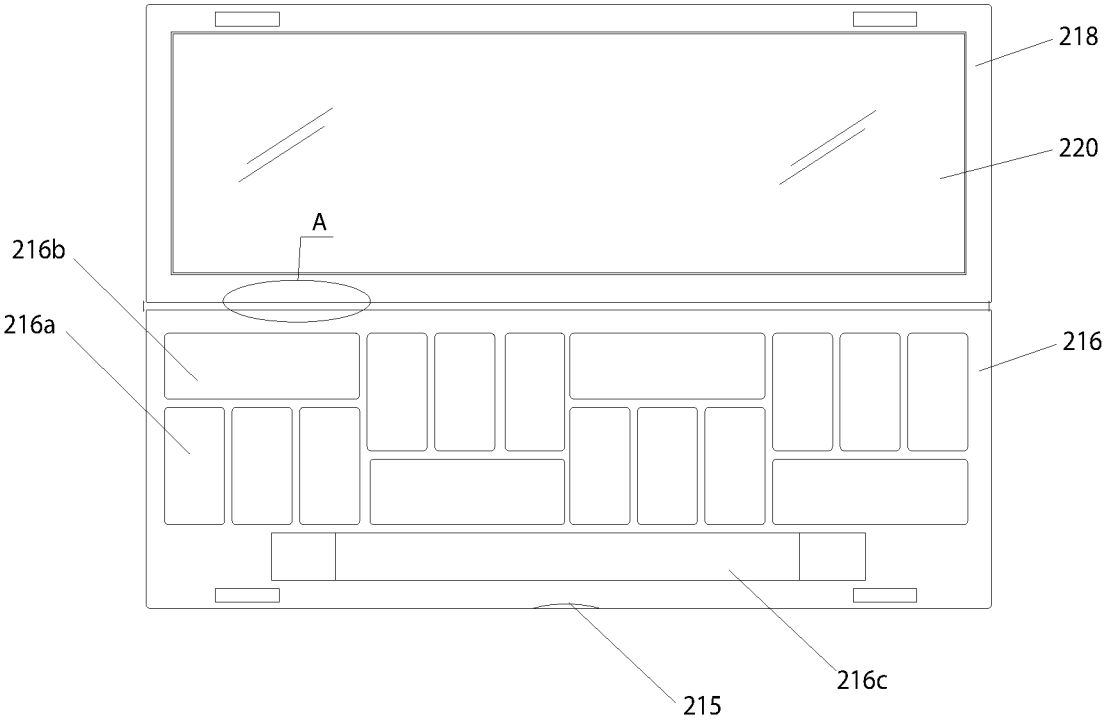
FIG. 28 is a top view of the cosmetic compact as shown in FIG. 22 in an opened position.
Figure 31:
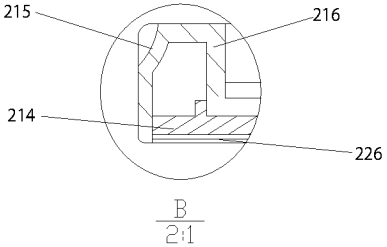
FIG. 31 is a close-up, cross-sectional view of the cosmetic compact as shown in Section B, FIG. 30.
Figure 34:
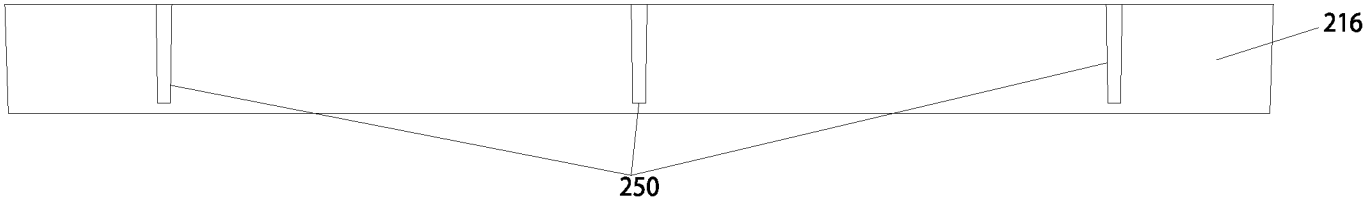
FIG. 34 is a back view of a platform of the cosmetic compact as shown in FIG. 22.
Figure 35:
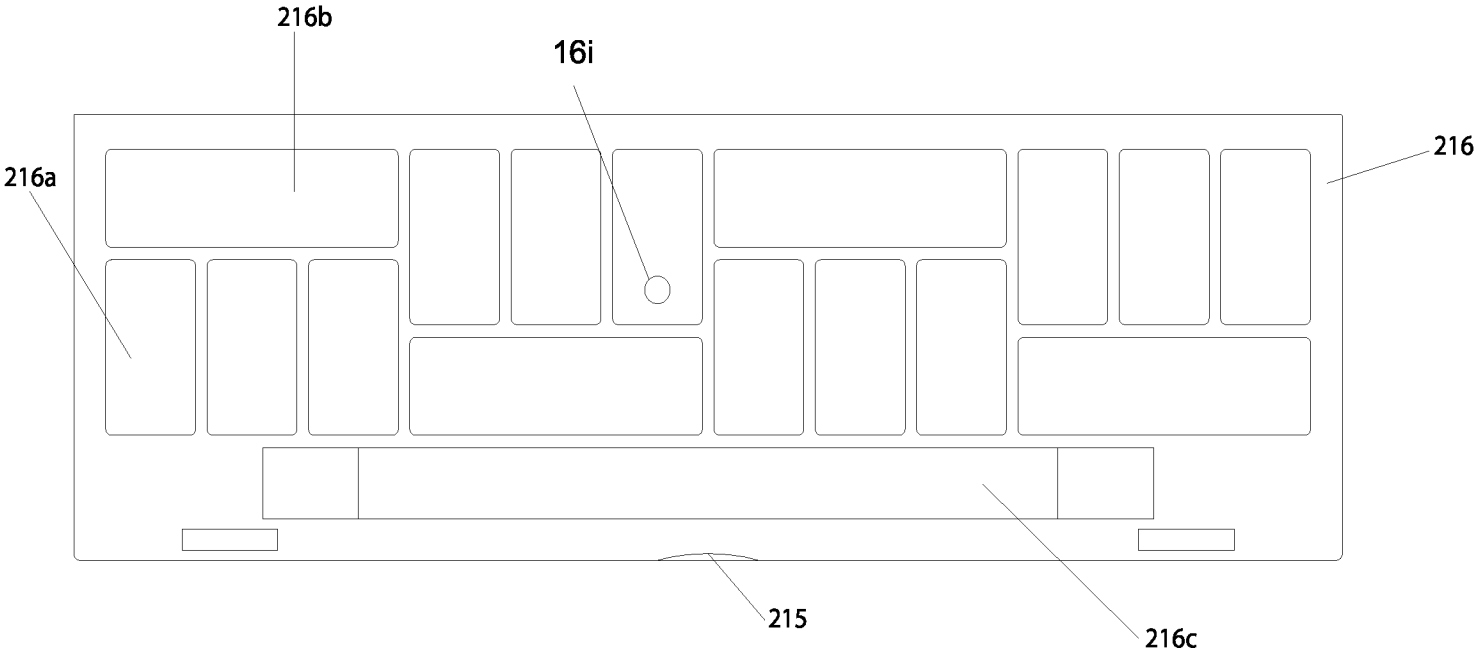
FIG. 35 is a top view is of a platform of the cosmetic compact as shown in FIG. 22.
Figure 36:
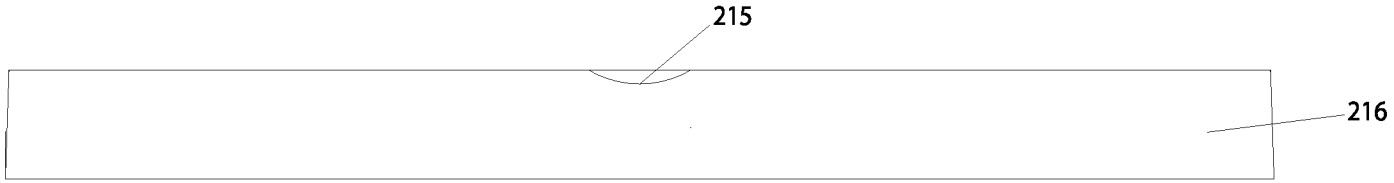
FIG. 36 is a front view is a top view of a platform of the cosmetic compact as shown in FIG. 22.
Figure 40:
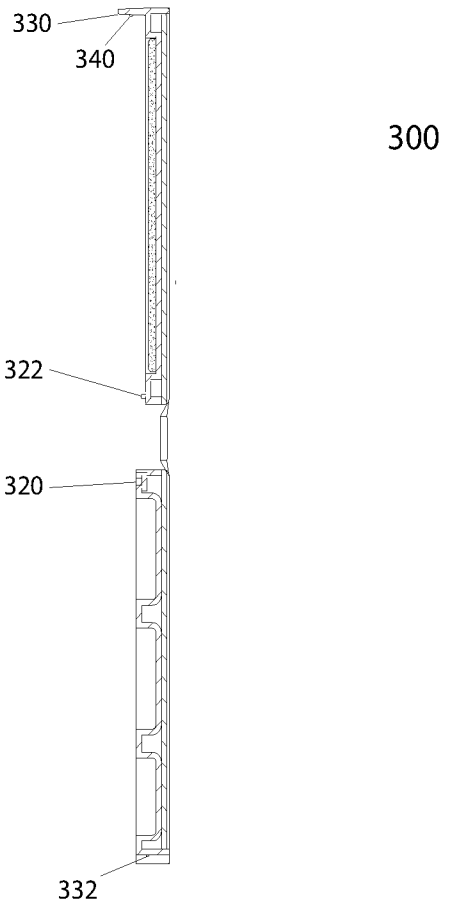
FIG. 40 is a cross-sectional, side view of a cosmetic compact of the disclosed technology.
Figure 39:
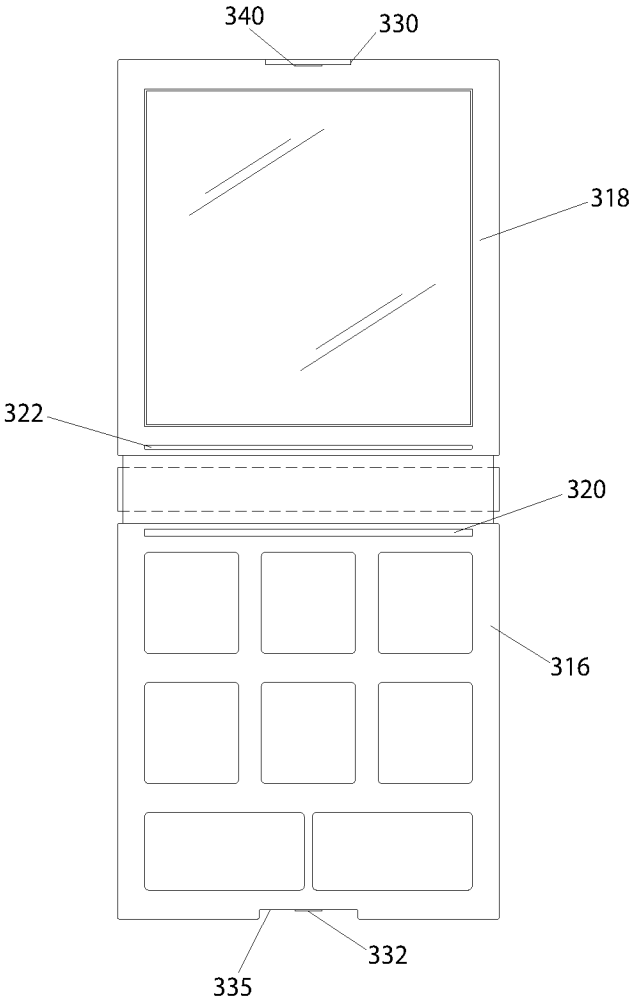
FIG. 39 is an open view of a cosmetic compact of the disclosed technology.
Figure 41:
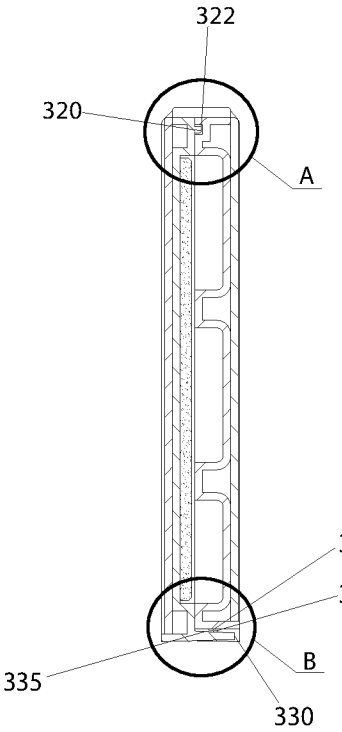
FIG. 41 is a cross-sectional, side view of the closed view of a cosmetic compact of the disclosed technology.
Figure 42:
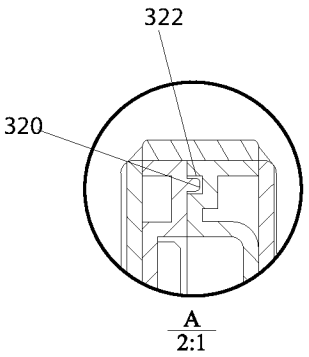
FIG. 42 is a close-up of a cross-sectional, closed side view of a cosmetic compact of the disclosed technology as shown in Section A, FIG. 41.
Figure 43:
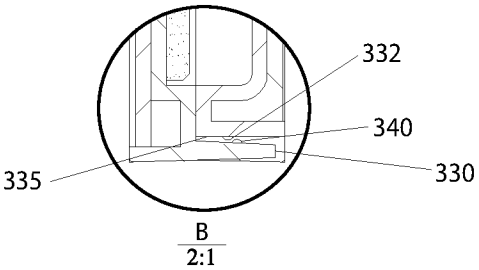
FIG. 43 is a close-up of a cross-sectional, closed side view of a cosmetic compact of the disclosed technology as shown in Section B, FIG. 41.

One of the sidewalls 208*b* of the platform 216 can also include an indent 215 as shown in in FIGS. 22, 28 and 31. This indent 215 can be used for opening the cosmetic compact 200 when in a closed position.

The bottom panel 214 can be flat having a rectangular shape but other shapes are contemplated. The bottom panel 214 can also include sealing seams 215*a* and 215*b*. The bottom panel 214 can be sized so that it fits within the sidewalls 208*a-c* of platform 216.

As shown in FIG. 22, the mirror frame 218 can include sidewalls 209*a-d*. The top panel 212 can be flat and have a rectangular shape but other shapes are contemplated. The top panel 212 can also include sealing seams 213*a-d*. The bottom panel 214 can be sized so that it fits within the sidewalls 209*a-d* of mirror frame 218.

The mirror frame 218 can be formed with an opening 221 for receiving a mirror 220. The mirror 220 can be placed within the opening 221 and adhered to the top panel 212 through the use of an adhesive; however, other adhesive methods are contemplated. The mirror frame 218 can also have a well instead of an opening, and the mirror 220 can be adhered to the bottom of the well in the mirror frame 218.

Figure 25:
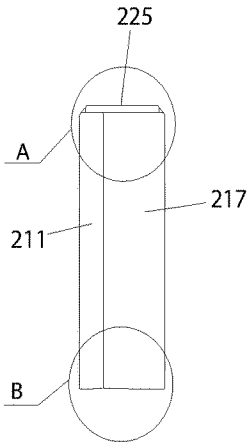
FIG. 25 is a side view of the closed cosmetic compact as shown in FIG. 22 in a closed position.
Figure 23:
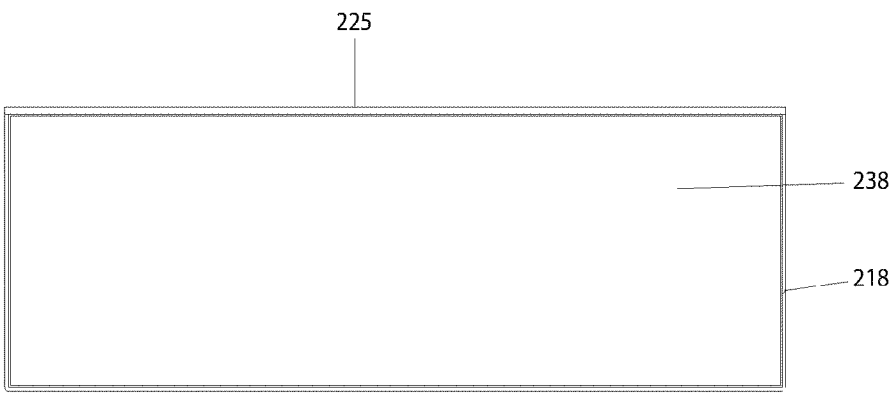
FIG. 23 a top view of the cosmetic compact as shown in FIG. 22 in a closed position.
Figure 29:
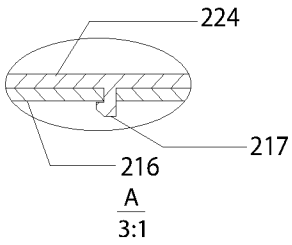
FIG. 29 is a close-up, cross-sectional view of the cosmetic compact as shown in Section A, FIG. 28.
Figure 32:
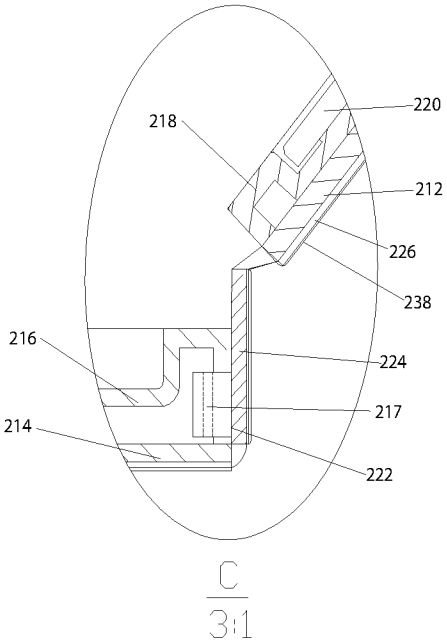
FIG. 32 is a close-up, cross-sectional view of the cosmetic compact as shown in Section C, FIG. 30.
Figure 30:
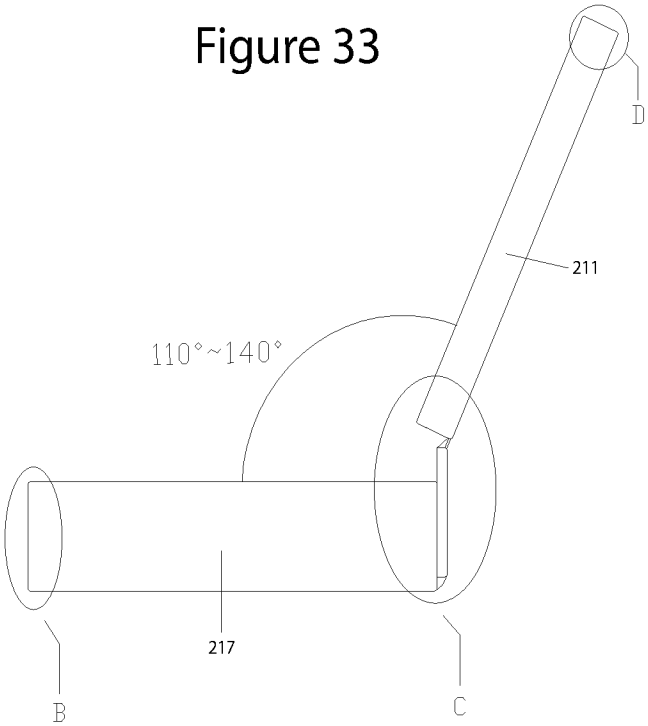
FIG. 30 is a side view of the cosmetic compact as shown in FIG. 22 in an opened position.
Figure 33:
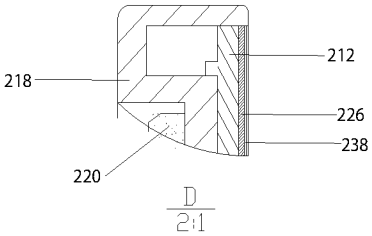
FIG. 33 is a close-up, cross-sectional view of the cosmetic compact as shown in Section D, FIG. 30.

The spine 224 can be adhered to a spine wrap 222 with an adhesive and form part of a hinge 225 (FIGS. 23 and 25). In some implementations, the spine 224 can be connected to the platform 216 through a mechanical fit as show in FIGS. 30 and 32. That is, the spine 224 can include posts 217 (FIG. 22) that enter cavities 250 (FIG. 34) on a sidewall of the platform 216. Once the posts 217 are secured within the cavities 250 (FIG. 29) with a snap fit they are unable to be removed.

The hinge 225 can also include angle control tabs 219 used to restrict the compact from fully opening. The angle control tabs 219 allow the cosmetic compact to open at a specific opening range as predetermined, e.g. 100 to 140 degrees. The angle control tabs 219 can be secured with placement openings 201 on the spine 224 and the top panel 212 (FIG. 22). This innovation allows the combination of injection parts with a material to create the hinge 225.

The mirror frame 218 and the platform 216 can also be fitted with magnets 228, 230. Magnets 230 can be secured within recesses on frame 218 and magnet 228 can be secured within recesses on a ledge of the platform 216. The magnets can be adhered with heat melt glue but other securement methods are contemplated. These magnets 228, 230 are capable of magnetically securing the compact 200 in a closed position when not in use while the top cover 211 (FIGS. 24 and 25) and the cosmetic holder 217 (FIGS. 24 and 25) can provide a tight fit of contact for the cosmetic compact 200 when in a closed position so that cosmetic material does not escape the cosmetic compact 200 when not in use. PETG Disc 232, LDPE, wax paper and other materials can be contemplated and applied over the platform 216 to seal the cosmetic material in place. In some implementations, individual cosmetic trays or applicators can be placed in the wells 216*a-c* that can be either removable secured or permanently secured within the wells 216*a-c* depending on application requirements.

An outer wrap material 226 e.g. paper, plastics, polyurethane, fabrics, metals, or foils can be adhered to an outer surface of the top cover 211, the cosmetic holder 217 and the hinge 225 as a single piece after assembly. In other implementations, the outer wrap material 226 can be adhered in one or more pieces. The outer wrap material 226 can also be decorated with lenticular prints 238 for marketing and advertising purposes.

In some implementations, the outer wrap material 226 can be pre-cut to size so that it has the same width as the top panel 212, bottom panel 214 and spine 224. The outer wrap can have a length to accommodate a combined length of the top panel 212, bottom panel 214 and spine 224. The outer wrap can also have a space between the spine and top panel and a space between the spine and bottom panel wherein the spaces allows room for the cosmetic compact 22 to open and close.

During assembly, the top panel 212, the spine 224 and the bottom panel 214 can be glued to the outer wrap material 226 with an adhesive and the edges of the outer wrap 226*a* and 226*b* can be folded over to the indentations of the spine 224 glued with an adhesive. Step 1. Magnets 228 and magnets 230 can be glued with the recesses of the platform 216 and mirror frame 218, respectively. Step 2.

Angle control tabs can be glued within recesses 201 on the top panel 212 and the spine 224. Step 3. The spine wrap can be adhered over the spine 224. Step 4. The posts 217 of the spine 224 are snap fitted with recesses 250 of the platform 216. Step 5.

Figure 24:
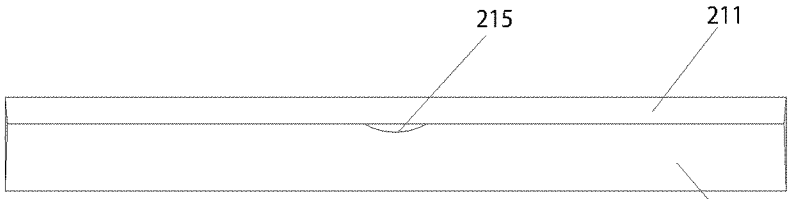
FIG. 24 is a front view of the cosmetic compact as shown in FIG. 22 in a closed position.
Figure 27:
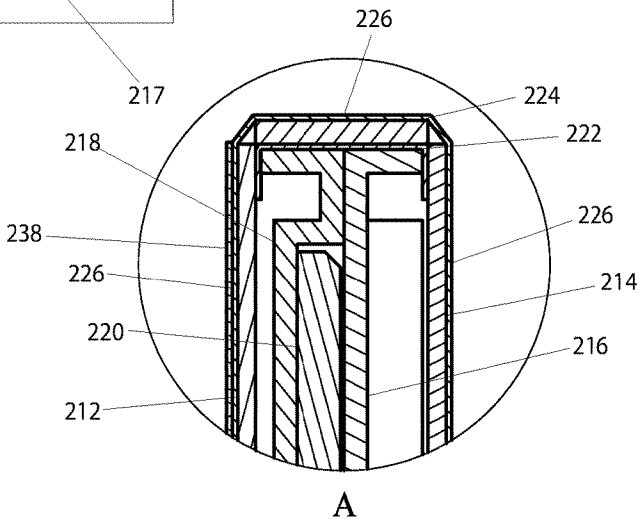
FIG. 27 is a close-up, cross-sectional view of the cosmetic compact as shown in Section A, FIG. 22.
Figure 26:
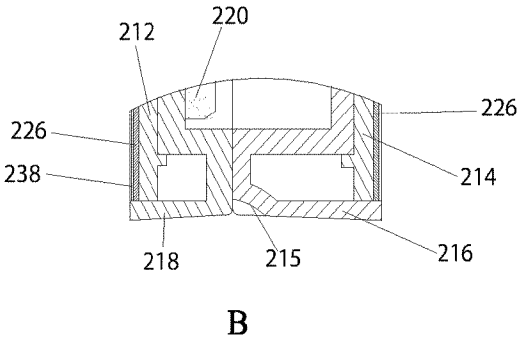
FIG. 26 is a close-up, cross-sectional view of the closed cosmetic compact as shown in Section B, FIG. 22.

The platform 216 is then fitted to and adhered to the bottom panel 214. Step 6. More specifically, the bottom panel 214 can be placed within the sidewalls 208*a-d* of the platform 216 so that the sidewalls 208*a-c* hide the edges of the outer wrap material 226. This placement allows the sealing seams 215*a-b* to be adjacent and touching the walls of well 216*c*. A sonic weld can then be performed to weld sealing seam 215*a* and 215*b* to well 216*c*. Other adhesive mechanisms are contemplated, e.g., adhesives. This step (Step 6) forms the cosmetic holder 217 (FIGS. 24 and 25).

The mirror frame 218 can be adhered to the top panel 212. Step 5. More specifically, the top panel 212 can be placed within the sidewalls 209*a-d* of mirror frame 218 so that the sidewalls 209*a, c-d*, hide the edges of the outer wrap material 226. This placement allows sealing seams 213*a-d* of are adjacent and touching the sidewalls 209*a-d* of mirror frame 218 so that a sonic weld can be performed to weld sealing seams 213-*d* to the sidewalls 209*a-d* of mirror frame 218. This step (Step 7) forms a top cover 211 (FIGS. 24 and 25). Please note, steps 3-5 can be done one at time or simultaneously.

The mirror 220 can then be glued within the mirror frame 218 (Step 8), a dust cover can be placed over the platform (Step 9) and a lenticular print 238 can be adhered to the top of the compact 200. Once these steps (Steps 1-7) are completed, the cosmetic compact can be folded closed and packaged for shipping. Please note, that the order of these steps are for illustrative purposes as these steps can be performed in a number of different combinations.

In another implementation, shown in FIGS. 39-43, the cosmetic compact 300 can include a top cover 318 having extruding tabs 322, 330, 340 and a platform 316 having recesses 320, 335 as well as an extruding tab 332. In a closed position, the tabs 322, 330, and 340 can be friction fitted into the recesses 320, 332 and past extruding tab 335. This allows the compact 300 to close with friction when the cover 318 and the platform 316 are pushed together to close the compact 300. That is, the extruding tabs 322, 330, 340, 335 and recesses 320, 330 allow the compact 300 to stay in a closed position when not in use so that cosmetic material does not escape the cosmetic compact 300 when not in use. The extruding tab 330 can also have an external thumb notch (not shown) for the costumer to apply force, and while holding the base make an upward motion and open the compact.

While presently preferred embodiments have been described for purposes of the disclosure, numerous changes in the arrangement can be made by those skilled in the art. Such changes are encompassed within the spirit of the invention.

The foregoing Detailed Description is to be understood as being in every respect illustrative and exemplary, but not restrictive, and the scope of the disclosed technology disclosed herein is not to be determined from the Detailed Description, but rather from the claims as interpreted according to the full breadth permitted by the patent laws. It is to be understood that the embodiments shown and described herein are only illustrative of the principles of the disclosed technology and that various modifications may be implemented by those skilled in the art without departing from the scope and spirit of the disclosed technology. Those skilled in the art could implement various other feature combinations without departing from the scope and spirit of the disclosed technology. Although the embodiments of the present disclosure have been described with specific examples, it is to be understood that the disclosure is not limited to those specific examples and that various other changes, combinations and modifications will be apparent to one of ordinary skill in the art without departing from the scope and spirit of the disclosed technology.

The invention claimed is:

1. A cosmetic compact comprising:

a cover, the cover including a frame and a top panel, the frame including four sidewalls;

a cosmetic holder, the cosmetic holder including a platform and a bottom panel, the platform including four sidewalls, a hinge; and an outer wrap material, wherein the top panel, the bottom panel and the hinge are affixed to the outer wrap material in a first step and (1) the frame is fixedly secured to the top panel and (2) the platform is fixedly secured to the bottom panel in a second step thereby allowing the outer wrap material to be incorporated into the cosmetic compact;

wherein the top panel and outer wrap material are provided within at least one of the four sidewalls of the frame such that at least one edge of the top panel and at least one edge of the outer wrap material is hidden within the at least one sidewall of the frame.

2. The cosmetic compact of claim 1 wherein with the top panel is affixed within the boundaries created by the four sidewalls of the frame.

3. The cosmetic compact of claim 2 wherein with the bottom panel is affixed within the boundaries created by the four sidewalls of the platform.

4. The cosmetic compact of claim 1 wherein the hinge includes a spine and spine wrap, wherein the spine wrap is adhered to the spine.

5. The cosmetic compact of claim 4 wherein the outer wrap material has a width equal to a width of the top panel, the bottom panel and the spine so that the outer wrap material is within the boundaries created by three of the four sidewalls of the frame and the boundaries created by three of the four sidewalls of the platform when assembled.

6. The cosmetic compact of claim 5 wherein the outer wrap material has a length greater than a length of the top panel, the bottom panel, the spine.

7. The cosmetic compact of claim 6 wherein spacing is created between (1) the top panel and the spine and (2) the bottom panel and the spine.

8. The cosmetic compact of claim 7 wherein the spacing allows the hinge to movably connect the cosmetic holder to the cover.

9. The cosmetic compact of claim 4 wherein the spine includes posts and the platform includes recesses for receiving the posts, the spine being fixedly secured to the platform.

10. The cosmetic compact of claim 9 further comprising:

angle control tabs, the angle control tabs being secured to and between the spine and frame.

11. The cosmetic compact of claim 4 wherein the outer wrap material includes wings.

12. The cosmetic compact of claim 11 wherein the spine includes raised edges for receiving the wings of the outer wrap material.

13. The cosmetic compact of claim 1 wherein the frame includes an opening for a mirror.

14. The cosmetic compact of claim 1 wherein the frame and platform includes magnets.

15. The cosmetic compact of claim 1 wherein the platform includes one or more wells for retaining cosmetic materials.

16. The cosmetic compact of claim 1 wherein the frame includes tabs for friction fitting with recesses of platform for securing the cosmetic compact in a closed position.

17. The cosmetic compact of claim 1, wherein the bottom panel and outer wrap material are provided within at least one of the four sidewalls of the platform such that at least one edge of the bottom panel and at least one edge of the outer wrap material is hidden within the at least one sidewall of the platform.

18. A cosmetic compact comprising:

a cover, the cover including a frame fixedly secured to a top panel, the frame including a top sidewall and a left and right sidewall on opposite sides of the top sidewall;

a cosmetic holder, the cosmetic holder including a platform fixedly secured to a bottom panel, the platform including a bottom sidewall and a left and right sidewall on opposite sides of the bottom sidewall;

a hinge provided between the frame and platform; and an outer wrap material;

wherein the top panel, the bottom panel and the hinge are affixed to the outer wrap material;

wherein the top panel and outer wrap material are provided within the frame such that corresponding edges of the top panel and the outer wrap material are hidden within the top sidewall, left sidewall and right sidewall of the frame; and wherein the bottom panel and outer wrap material are provided within the platform such that corresponding edges of the bottom panel and the outer wrap material are hidden within the bottom sidewall, left sidewall and right sidewall of the platform.

19. A cosmetic compact comprising:

a cover, the cover including a frame fixedly secured to a top panel;

a cosmetic holder, the cosmetic holder including a platform fixedly secured to a bottom panel;

a hinge provided between the frame and platform, wherein the hinge comprises a spine having indentations on opposite sides thereof and a spine wrap laminated to the spine; and an outer wrap material;

wherein the top panel, the bottom panel and the hinge are affixed to the outer wrap material and edges of the outer wrap material are provided over the indentations on the spine.

* * * * *